US006588332B1

(12) United States Patent
Zaoralek et al.

(10) Patent No.: US 6,588,332 B1
(45) Date of Patent: Jul. 8, 2003

(54) ROLLER GROUP

(75) Inventors: Heinz-Michael Zaoralek, Koenigsbronn (DE); Juergen Krueger, Aalen (DE); Bernd Eppli, Koenigsbronn (DE); Julien Tenelsen, Heidenheim (DE)

(73) Assignee: Schwabische Huttenwerke GmbH (DE)

( * ) Notice: Subject to any disclaimer, the term of this patent is extended or adjusted under 35 U.S.C. 154(b) by 0 days.

(21) Appl. No.: 09/720,156

(22) PCT Filed: Jun. 28, 1999

(86) PCT No.: PCT/DE99/01876

§ 371 (c)(1),
(2), (4) Date: Apr. 27, 2001

(87) PCT Pub. No.: WO00/00694

PCT Pub. Date: Jan. 6, 2000

(30) Foreign Application Priority Data

Jun. 29, 1998 (DE) ..... 198 28 722

(51) Int. Cl.[7] ..... B30B 3/04
(52) U.S. Cl. ..... 100/163 R; 100/169; 100/176
(58) Field of Search ..... 100/155 R, 329, 100/339, 163 R, 162 R, 35, 38, 163 A, 169, 176

(56) References Cited

U.S. PATENT DOCUMENTS 4,510,859 A * 4/1985 Berry ..... 100/162 R
5,156,086 A * 10/1992 Kiema et al. ..... 100/331
5,343,801 A * 9/1994 Schiel ..... 100/162 B
5,784,955 A * 7/1998 Conrad ..... 100/162 R

* cited by examiner

*Primary Examiner*—Allen Ostrager
*Assistant Examiner*—Shelley Self
(74) *Attorney, Agent, or Firm*—Fish & Richardson P.C.

(57) ABSTRACT

In a group of rolls for a calender for processing material webs, comprising at least two rolls each having a roll body made of a cast or forged iron material, at least one of the roll bodies consists of chilled cast iron or shell-chilled cast iron. One or more rolls may have a cover of a resilient material, such as a polymeric plastic. Although it is possible for the outer diameters of the rolls to differ, the sag of the rolls when they are supported only in their rolling-contact bearings is substantially equal. In order to produce appropriate rolls, following the essential machining steps of the roll bodies, that is to say, for example, following casting, following preliminary turning, following preliminary boring and, if appropriate, following the introduction of peripheral bores, the actual mean modulus of elasticity of the entire roll body is measured and, as a function of this, in particular the inner diameters of the central bores are produced. In addition, methods for influencing the sag of the rolls in a deliberate way, by selecting appropriate materials, the relationships of material structures in the roll body or by means of the deliberate introduction of ballast into the central bore or else into separate peripheral bores in the roll bodies, are described.

35 Claims, No Drawings

ROLLER GROUP

BACKGROUND

Modern multiroll calenders, in which hard, heated and soft, plastic-covered rolls are used simultaneously, could be used particularly effectively for the calendering of paper if the intermediate rolls were in each case to be lifted in their bearings to such an extent that the nip lying underneath them was relieved of the inherent roll weight. It would then be possible to set the same line pressure, from zero up to the maximum pressure, in all the nips by means of a top and bottom pressure roll, by exerting pressure on the entire roll assembly. However, this can only be realized if all the rolls in the calender exhibit substantially equal bending lines if they are held in the bearings at the journal and are bent only by their dead weight.

The proposal to equip a calender with such rolls emerges, for example, from U.S. Pat. No. 5,438,920. In that patent, the intermediate rolls are described as rolls in which the shape of the natural deflection line produced by their dead weight is substantially equal. However, it does not emerge from the patent specification how such rolls having substantially equal bending lines can be produced. This is because it is in no way trivial and is not readily possible for the average person skilled in the art, even if he masters the principal relationships between weight of a bending beam, its moment of inertia, the modulus of elasticity of the beam material and the spacing of the supports (cf., for example, H ütte, 28th Revised edition, published by Wilhelm Ernst und Sohn, Berlin 1955, pp. 876–892).

In the PCT patent application WO 95/14813, reference is also made only to the fact that the bending lines which are produced by gravity in the case of each intermediate roll have to be dimensioned such that their shapes are substantially equal. In response to the question as to how this is to be managed, the Applicant merely indicates that the intermediate rolls "were chosen in this way". Selection methods of this type are known, for example in the case of producing balls with substantially equal diameters for precision ball bearings. However, from an economic point of view it is scarcely possible to conceive the production of a relatively large number of rolls for calender rolls and to choose from them those whose natural bending lines substantially agree.

There is a similar objective in so-called doubling calenders for producing multilayer tissue webs. In such a two-roll calender, two or more separately produced layers of fine paper fabrics are led together and pressed lightly together. This produces a muitilayer end product such as, for example, toilet paper or paper handkerchiefs. The line pressure in the nip is far lower than would be produced, for example, by simply bringing the top roll into contact. Here, too, the nip must be substantially relieved of the dead weight of the top roll. In order that the pressure profile in the nip is uniform, it is also advantageous here to use rolls with substantially coincident bending lines. The prior art here is to produce the rolls from the same material and with identical geometry, and to accept the unavoidable scatter in the material properties in terms of their effect on the bending lines. In another design, a roll which sags naturally as a result of its dead weight is combined with a further roll, whose bending line can be adapted to the first by means of an internal hydraulically acting adjustment. However, this is a complicated and correspondingly expensive solution.

PRIOR ART

In general, it is to be emphasized that rolls with equal sag in the strict sense were hitherto not available. This is based on a whole series of technical limitations:

1) Heated rolls in any form of calenders for the paper industry are almost exclusively produced with bodies made from shell-chilled cast iron. The economic production of chilled iron rolls is possible only within the framework of specific series of diameters, since each roll diameter has to be cast in a corresponding set of cast iron molds—so-called chill-casting molds. These diameters are typically graduated in steps of two inches (about 50 mm). The usual diameters for multiroll calenders are accordingly, for example: 505 mm, 560 mm, 610 mm, 660 mm, 710 mm, 760 mm, 812 mm, 860 mm, 915 mm.

2) Production results in a certain tolerance range of the outer diameter of the rolls. In the industry, this is usually taken to be ±1% of the roll diameter. Since the maximum deflection of the roll is inversely proportional to the moment of inertia of the roll cross section, and the latter is in turn proportional to the 4th power of the roll diameter, given otherwise constructionally identical rolls, this tolerance already means a difference of ±4% in the sag.

3) Chilled cast iron is a so-called inhomogeneous material. The physical properties fluctuate, both on account of the composition and on account of slight differences in the structure. Material properties measured on separately cast or even concomitantly cast samples have only a restrictedly precise meaningfulness for the effective structure in the roll body itself. Deviations in the modulus of elasticity, which,can be measured precisely only to a few percent on samples, as a result of the inhomogeneity and the tolerance of the measuring method, have an inversely proportional effect on the sag. The specific density has a directly proportional influence. Material properties measured in this way cannot be used as a basis for the design.

4) In addition, a great influence on the material parameters is exerted by the cooling speed during casting, which is decisive for the thickness of the pure chilling ("white heart iron") and the so-called transition zone. Since the pure white iron has a modulus of elasticity of about 180,000 $N/mm^2$, and gray nodular iron typically has a modulus of about 100,000 $N/mm^2$, deviations in the relative distribution of the two components lead to variations in the average modulus of elasticity, and thus also to a different amount of sag.

5) In the case of long rolls, there are similar variations in the axial direction, since the roll bodies are cast upright in the mold.

6) The associated polymer-covered rolls should be designed as far as possible with a diameter of the finished roll which approaches that of the heated, hard rolls or corresponds to an adjacent diameter in the standard series. It is then possible to mix hard and soft rolls in any sequence in the calender, which provides the papermaker with greater flexibility in the construction of his calender when calendering. The outer diameter of the roll core is thus defined by the thickness of the polymer layer. If the usual roll materials are used, such as gray cast iron or spheroidal cast iron, the production of such rolls with identical bending lines encounters great difficulties, since the moduli of elasticity are very different.

7) During operation, the polymer layer of the resilient rolls has to be re-machined. Depending on the layer type, it loses up to 15 mm of its thickness before being renewed. Since the layer contributes only to the weight of the roll but not to its stiffness, this means that the "worn" roll sags less than the new roll.

In the case of the chilled cast iron roll, this is exactly the opposite. Although the diameter of the roll is reduced only slightly when it is reground, the number of grinding operations is relatively high. During the service life of the roll, the white chilled layer is thus reduced considerably. However, since this has a strong influence on the sag of the roll, because of its high modulus of elasticity, the sag will increase gradually as this layer is ground away.

8) The modulus of elasticity both of the hard cast iron and of other iron materials depends on temperature whereas hard rolls are generally operated at temperatures around 120° C. and higher, the polymer-covered roll bodies are in any case uniformly temperature controlled. This also results in different bending lines during operation.

9) Finally—particularly in the case of polymer-covered rolls—differences in design are also important. For instance, rolls are bored peripherally or also implemented with a displacement body in the central bore.

DESCRIPTION OF THE INVENTION

The invention pertains to a group of substantially equally flexible rolls and the method of producing such a group of rolls. Equally flexible rolls according to the invention refers to such rolls which exhibit substantially identical amounts of sag. The sag f is to be understood as the vertical deflection of the roll axis when the roll is bent in the center of the roll body and related to the position of the roll axis at the web ends. Whereas the bending line can be measured only in a very complicated manner, various ways of determining the sag are indicated below. For the intended purpose, the ascertaining and influencing of the sag can be replaced with sufficient accuracy by that of the bending line.

A group of rolls of this type comprises at least two or, if a multiroll calender is concerned, of a plurality of rolls arranged one above another, of which at least one has a roll body made of chilled cast iron or shell-chilled cast iron, as well as having further rolls with roll bodies likewise made of chilled cast iron or shell-chilled cast iron or of a cast iron with lamellar, vermicular or spheroidal graphite formation, which are then provided with a resilient cover. The rolls are enclosed by a top and bottom roll in each case, the sag of which is adjustable by means of hydraulic built-in fittings, and also make it possible to vary the line pressure exerted on the roll group. The problems of different sag may be neglected for small rolls with diameters smaller than 500 mm and a web length:diameter ratio less than 7.

In a roll group of this type, a distinction must be drawn between a so-called reference roll and the rolls dependent thereon. This does not include the top and bottom rolls, since their sag can be changed not only by the dead weight but also actively by means of pressure adjustments in the hydraulic built-in fittings.

According to the invention, the reference roll is a chilled cast iron or shell-chilled cast iron roll, which has a central bore, a wall thickness between 100 and 300 mm and a natural sag under the influence of gravity of between 0.1 and 0.2 mm per meter web length when they are suspended in their bearings, which are arranged at the journals. The diameter of the central bore is located approximately at the center of a region whose upper end is determined by the constructively determined minimum wall thickness of the roll body and whose lower end is determined by the lowest possible roll weight.

The other rolls in the roll group may be made either of chilled cast iron or shell-chilled cast iron, but can also be produced from other suitable materials. If they are provided with a resilient cover, they will generally consist of cast iron, but may also consist of forged steel. Their weight without journals corresponds to the formula $$G = G_{ref} \times E \times J \times f/(E_{ref} \times J_{ref} \times f_{ref})$$

Here:

| | | |
|---|---|---|
| $G_{ref}$ | = | weight of the reference roll body (N) (without journals) in the region of the web length L |
| $E_{ref}$ | = | modulus of elasticity of the reference roll body (N/m$^2$) |
| $J_{ref}$ | = | moment of inertia of the cross section of the reference roll body (m$^4$) |
| $f_{ref}$ | = | sag of the reference roll (m) |
| E | = | modulus of elasticity (N/m$^2$) |
| J | = | moment of inertia of the roll cross section (m$^4$) |
| f | = | intended sag (m) |

Their central bore corresponds to the formula:

$$\text{bore diameter}=(D^4-G\times K_G/(f\times E))^{1/4},$$

if the roll bodies do not have any peripheral bores. With peripheral bores:

$$\text{bore diameter}=(D^4-Z_P\times D_P^2\times(D_P^2+2\times T_P^2)-G\times K_G/(f\times E))^{1/4}.$$

Here:

| | | |
|---|---|---|
| G | = | weight of the roll body (N) in the region of the web length |
| E | = | modulus of elasticity (N/m$^2$) |
| D | = | outer diameter (m) |
| f | = | intended sag (m) |
| $K_G$ | = | group constant (m$^3$) from Equation (3) |
| $Z_p$ | = | number of peripheral bores |
| $D_p$ | = | diameter of the peripheral bores (m) |
| $T_p$ | = | pitch circle (m) of the peripheral bores |

If rolls with resilient covers are concerned, these covers have a thickness of between 10 and 30 mm and a loadbearing metallic body with the diameter $$D = D_{rel} - 2 \times (dp - ap)$$

Here:

| | | |
|---|---|---|
| $D_{rel}$ | = | relative diameter (m) |
| dp | = | thickness of the new polymer cover (m) |
| ap | = | maximum possible wear of the polymer cover (m). |

At the same time, for the diameter D it is true that:

$$D=(16\times G\times K_G/(15\times E\times f_{ref}))^{1/4},$$

with the final D as the next diameter to be produced economically.

Here:

| | | |
|---|---|---|
| G | = | weight of the roll body (N) in the region of the web length L |
| E | = | intended modulus of elasticity (N/m$^2$), e.g. 180,000 for gray cast iron with spheroidal graphite |

-continued

| | | |
|---|---|---|
| $f_{ref}$ | = | sag (m) of the reference roll |
| $K_G$ | = | group constant ($m^3$) from the following equation: |

$$KG=(5/(6\times\pi))\times L^3\times(1+2.4\times(LM-L)/L+2\times(D_{ref}/L)^2)$$

Here:

| | | |
|---|---|---|
| $\pi$ | = | circular constant (3.14159 . . . ) |
| L | = | web length of the roll group (m) |
| LM | = | bearing-center spacing of the roll group (m) |
| $D_{ref}$ | = | diameter of the reference roll (m) |

In order that the arrangement of the rolls in the calender can be configured relatively freely, use is expediently made of rolls which are substantially equal in terms of their outer diameters. Undesired oscillations of the rolls can be avoided if the latter are dimensioned such that they do not have to be operated close to the semicritical rotational speed. Finally, for the still more precise determination of the sag, all the rolls may be provided with ballast materials or ballast bodies in the central bore or the peripheral bores, it also being possible for these materials to be fed in, taken away or adjusted during operation.

In the following text, the production of an appropriate group of rolls is to be described in more detail:

The determination of the roll diameters for rolls of a multiroll calender begins with the chilled cast iron rolls, since this determination is to be carried out in accordance with the maximum permissible sag. It is determined by means of the technical capabilities of sag compensation of the top and bottom rolls, which generally have this capability in the case of multiroll calenders. It is expedient for a chilled cast iron roll to be determined as reference roll. The outer diameter and the diameter of the central bore, which every relatively large roll has for the purpose of reducing weight, should lie approximately at the center of the respective tolerance and feasibility areas.

Within the context of the expected scatter of the modulus of elasticity, a permissible range for the sag is then determined. This range may be narrowed by its being possible for the effect of different moduli of elasticity on the sag being compensated for by modifying the diameter of the central bore.

The sag of a roll suspended in the bearings is determined specifically by the weight of the roll body, the modulus of elasticity of the roll material and the moment of inertia of the roll cross section. Reducing the size of the central bore increases the weight and increases the moment of inertia, but the latter only to a low extent, so that the roll sag can be increased by reducing the size of the bore.

Within the usual production tolerances of rolls from chilled cast iron or shell-chilled cast iron, it is possible for the outer diameter of the roll body to fluctuate by ±1% as a result of production. This tolerance can be restricted with a certain extra expenditure, which is generally avoided, since adjustment to different roll diameters in the calender is possible in a simple way. For the production of substantially equally flexible rolls, use can be made of this relatively small span, since a variation in the outer diameter of only ±1% changes the sag of the roll under its dead weight by about −/+2%.

However, during the final determination of the outer diameter, it has to be taken into account that a reduction in the diameter results from regrinding during the course of using the roll. Under certain circumstances, a compromise has to be found, with the effect that the duration of use of the roll, and hence the permissible regrinding dimension, is reduced.

According to the invention, it is also necessary to fix the diameter D of the roll body to be provided with a polymer cover so as to correspond to the stressing of the cover and its durability. In the case of very high loadings as a result of line pressure, rotational speed and temperatures, or less durable covers, a decision is made to use the largest possible roll diameter. With a view to the desired equality of bending, a material having a low modulus of elasticity between 90,000 and 120,000 N/mm$^2$ is then used.

Conversely, in the case of lower stressing of the resilient cover or of a resilient covering material that can be highly loaded, a smaller roll diameter can be provided. A modulus of elasticity between 170,000 and 185,000 N/mm$^2$ should then preferably be used.

For average loadings, according to the invention use is made of a cast iron whose modulus of elasticity lies in a wide range between 130,000 and 160,000 N/mm$^2$.

A part of the invention is therefore also the capability of influencing the modulus of elasticity of cast iron in large roll bodies to correspond to the requirements of the production of rolls with substantially equal sag. It depends decisively on the graphite that is introduced into the iron structure. If this is in the form of lamellae (gray cast iron), then a notching effect is produced under tensile loading, which weakens the basic material and sharply reduces the modulus of elasticity. The latter is then 100,000 N/mm$^2$ and less. By alloying in magnesium, the surface tensions in the liquid state are changed to such an extent that the graphite assumes a spherical shape (spheroidal cast iron). The reduction in the modulus of elasticity of the basic material is then only low. Values up to 185,000 N/mm$^2$ are reached.

According to the invention, the inoculation technique and doping with magnesium are then modified in such a way that, during the deposition of graphite, intermediate forms between lamellar and spherical are established (vermicular cast iron). These intermediate forms make it possible to set the modulus of elasticity of the material in a range between 110,000 and 170,000 N/mm$^2$—preferably between 130,000 and 160,000 N/mm$^2$—precisely as is needed on the basis of the predefinitions. However, the technique for this suffers the burden of a relatively large scatter of the decisive material properties, since even the smallest variations in alloying and inoculation have considerable effects on the modulus of elasticity. Therefore, an exact determination of the actual modulus of elasticity of rolls is of the utmost importance, not only for the roll to be considered itself in each case, but also as a basis for the material decisions to be made continuously in future cases.

From the core diameter and the constructionally possible diameters for the central bores, there then results from the bending formula a range for the permissible moduli of elasticity of the roll material. In this case, the size of the bore is limited upward by the disturbance to the profile in the edge region of the roll which results from the fact that the roll body becomes oval under a linear load, but also from the need to accommodate heating or cooling bores in the roll body, these being required by the calendering process or by increasing the durability of resilient plastic covers. In the case of rolls with large outer diameters, the bore is likewise limited downward in order to limit the roll weights.

According to the invention, the diameter D of the roll body for substantially equally flexible rolls having a resilient cover is chosen to be $$D=D_{rel}-2\times(dp-ap).$$

Here:

| | | |
|---|---|---|
| $D_{rel}$ | = | relative diameter (m) |
| dp | = | thickness of the new polymer cover (m) |
| ap | = | max. possible wear of the polymer cover (m). |

In the case of rolls with a resilient cover and with basic bodies made of gray cast iron with lamellar graphite, the relative diameter $D_{rel}$ corresponds approximately to the next highest standard diameter in the series, in the case of gray cast iron with spheroidal graphite, the relative diameter $D_{rel}$ corresponds approximately to the next lowest standard diameter in the series, or in the case of a basic roll body made of gray cast iron with vermicular graphite, the relative diameter $D_{rel}$ corresponds approximately to the diameter of the reference roll. Since in the case of these materials—otherwise than in the case of shell-chilled cast iron—the allowance for machining, apart from economic considerations, can be selected freely, this definition only provides guidelines.

The finished diameter D of the roll body is to be chosen as the nearest diameter that can be produced economically, resulting from the formula $$D=(16\times G\times K_G/(15\times E\times f_{ref}))^{1/4}.$$

Here:

| | | |
|---|---|---|
| G | = | weight of the roll body (N) in the region of the web length L |
| E | = | intended modulus of elasticity ($N/m^2$), e.g. 180,000 for gray cast iron with spheroidal graphite |
| $f_{ref}$ | = | sag (m) of the reference roll |
| $K_G$ | = | group constant ($m^3$) from the following equation |
| $K_G$ | = | $(5/(6\times\pi))\times L^3\times(1+2.4\times(LM-L)/L+2\times(D_{ref}/L)^2)$ |

Here:

| | | |
|---|---|---|
| π | = | circular constant (3.14159 . . . ) |
| L | = | web length of the roll group (m) |
| LM | = | bearing-center spacing of the roll group (m) |
| $D_{ref}$ | = | diameter of the reference roll (m) |

Since the weight G of the roll body depends on its diameter, the latter is to be determined finally by means of iteration or further calculation.

Since the material characteristic values, such as the modulus of elasticity, cannot be determined sufficiently precisely from small samples, it is finally a constituent part of the invention that the average modulus of elasticity of the entire roll body is determined and monitored during the course of the production process by bending trials of the entire roll body, in each case starting points for the further machining of the roll bodies being obtained. For this purpose, the roll body is mounted and bent by applying defined forces. The bending of the entire body is measured. All of the material properties that are variable over the cross section, such as the modulus of elasticity and the specific density, for example, are thus registered jointly and simultaneously. From this, the actual mean modulus of elasticity can be calculated. Given progressive machining of the chilled cast iron body (rough turning of the surface, central boring, introduction of peripheral bores), these measurements may be repeated as required and, in this way, a mean modulus of elasticity which is final to a certain extent can be determined, for which it is then possible to define the precise diameter of the central bore which produces the desired sag. Without peripheral bores, it is true that:

$$\text{bore diameter}=(D^4-G\times K_G/(f\times E))^{1/4}$$

With peripheral bores, it is true that:

$$\text{bore diameter}=(D^4-Z_P\times D_P{}^2\times(D_P{}^2+2\times T_P{}^2)-G\times K_G/(f\times E))^{1/4}.$$

Here:

| | | |
|---|---|---|
| G | = | weight of the roll body (N) in the region of the web length |
| E | = | modulus of elasticity ($N/m^2$) |
| D | = | outer diameter (m) |
| f | = | intended sag (m) |
| $K_G$ | = | group constant ($m^3$) from the above-mentioned equation |
| $Z_p$ | = | number of peripheral bores |
| $D_p$ | = | diameter of the peripheral bores (m) |
| $T_p$ | = | pitch circle (m) of the peripheral bores |

The measuring methods used for the sag of the entire roll body in various production states, according to the invention, are for example:

Light Beam Method

The roll body, whose weight has previously been determined precisely to 0.5% by means of a precision balance, is mounted at the ends on roll stands. A light source—for example a laser—is fastened to the surface of the roll body in the center, its beam being split and directed axially parallel to two distance sensors, which are each fitted at the roll ends. The radial position of the points of incidence on the sensors is recorded. After the roll body has been rotated through 180°, the displacement of the radial position of the points of incidence is measured a second time. These displacements are a measure of twice the value of the sag of the roll body at the roll center under its dead weight. Using the measured values for the outer and inner diameters of the roll body, and the distance between the roll stands and between the sensors, it is then possible to ascertain the precise average modulus of elasticity of the roll body.

$$E=G\times L^3/(38.4\times f\times J)$$

Here:

| | | |
|---|---|---|
| E | = | modulus of elasticity in ($N/m^2$) |
| G | = | weight of the roll body (N) in the region of the web length L |
| L | = | distance between the roll stands (m) |
| f | = | measured change in the sag (m) |
| J | = | moment of inertia of the roll cross section ($m^4$) |

The light beam method has the advantage that a measurement can even be made on a finished roll, if the roll can be rotated in its own bearings. The equation for determining the modulus of elasticity is then:

$$E=G\times K_G\times\pi/(32\times L\times f\times J)$$

Here:

| | | |
|---|---|---|
| G | = | weight of the roll body (N) in the region of the web length L |
| $K_G$ | = | group constant ($m^4$) from the above mentioned equation |
| π | = | circular constant (3.14159 . . . ) |
| L | = | web length (m) |
| f | = | measured change in the sag (m) |
| J | = | moment of inertia of the roll cross section ($m^4$) |

Measuring Beam Method

A flexurally rigid measuring beam is placed in the axial direction on the roll body, being supported by pads at the roll ends. A distance measuring device, for example a dial gage, measures the distance of the roll body from the measuring beam at the roll center. If a defined vertical force is now exerted on the roll body at the roll center, this force deforms the body but not the measuring beam. From the change in the distance between measuring beam and roll body at the roll center, and the dimensions of the roll body, it is then possible for the precise average modulus of elasticity to be calculated directly:

$$E=P\times L^3/(48\times f\times J)$$

Here:

| | | |
|---|---|---|
| E | = | modulus of elasticity ($N/m^2$) |
| P | = | exerted force (N) |
| L | = | distance between the pads (m) |
| f | = | measured change in the sag (m) |
| J | = | moment of inertia of the roll cross section ($m^4$) |

Since the modulus of elasticity of cast iron materials depends on the load, the measurement should be repeated at different levels of force.

Measuring Bridge Method

The measurement may be carried out in a manner similar to the measuring beam method, if the roll body is supported at the ends on a stable base. By using measuring bridges at the ends and at the center of the roll body, the vertical displacement at these points in space as a result of applying a defined vertical force may be measured. Any possible resilient compliance of the pads can thus be eliminated by calculation. The formula for determining the mean modulus of elasticity corresponds to formula (7), the sag f being determined as follows:

$$f=f_m-(f_1+f_2)/2$$

Here, fm=indication at the roll center (m)

$f_1$, $f_2$=indication at the roll ends (m)

Eigenfrequency Method

From the measured eigenfrequency of a bending beam which is supported at both ends, it is possible to determine the sag under the dead weight, and hence the precise average modulus of elasticity of the roll body, via the simple relationship $$f=g/(4\times\pi^2\times n^2).$$

Here:

| | | |
|---|---|---|
| π | = | circular constant (3.14159 . . . ) |
| n | = | eigenfrequency (1/s) |
| g | = | gravitational acceleration (=9.81 $m/s^2$) |

With regard to the inventive application of these measuring methods, the common factor is that even relatively large systematic errors in the respective measuring methods do not play any part, provided the results of the measurement supply results which are reproducible with an accuracy <1%. The equal sag that is common to the group of rolls produced according to the invention may deviate in absolute terms from the measurement, but it is nevertheless possible to produce rolls with substantially mutually equal sag.

However, during the production of calender rolls for the paper industry, it has hitherto been usual to determine the exact weight of the rolls by weighing only in exceptional cases. Because of the not inconsiderable outlay when determining the high roll weights, weighings on individual roll bodies are seldom carried out. Approximate calculation formulas, which are supported by values from experience, are usual.

For peripherally bored rolls in the roll group with a resilient cover, it is possible, for example, for the following formula for the weight G of the entire roll to be applied, with an accuracy of a few percent $$G=60000\times(D^2-B^2)\times L$$

Here:

| | | |
|---|---|---|
| D | = | diameter (m) of the roll body |
| B | = | bore diameter (m) |
| L | = | web length (m) |

For the production and the operation of entire groups of rolls with substantially equal sag, the determination of the exact roll weights is important, however, as in the case of the measuring methods to be used, since these weights can fluctuate considerably, because of the different roll diameters, the resilient covers, the different specific material weights and the central bores that are to be dimensioned in order to produce the substantially equal sag. According to the invention, this is why the roll weights of the new rolls are to be determined precisely by calibrated precision balances and are to be used as a basis in accordance with the invention in ascertaining the diameter of the central bore. It is also expedient to append the weights to the roll documentation. The change in the roll weights during operation, as a result of wear-induced remachining, for example, can be followed on this basis with sufficient accuracy.

As mentioned further above, the sag of calender rolls changes in the course of their operational use. In the case of rolls made of shell-chilled cast iron, the chilled layer, which is hard and contributes disproportionally to the flexural rigidity of the roll, because of its high modulus of elasticity, is gradually reduced by regular regrinding. The sag of these rolls correspondingly increases. In the case of rolls with a resilient cover, this makes virtually no contribution to the flexural rigidity of the roll. However, it increases the roll weight. If this cover is remachined—which is done at regular intervals—the roll weight also decreases, and hence the sag.

A further change in the sag results in the case of variations in the operating temperature, on account of the modulus of elasticity decreasing with increasing temperature. Depending on the intended calendering result, the temperature of the heated rolls and the line pressure in the calender are increased. While the temperature of the heated rolls made of shell-chilled cast iron is influenced directly by means of a liquid or gaseous heat-transfer medium, which flows through the roll bodies, an increased pressure increases the flexing work in the resilient covers. The frictional heat produced in this way leads to increases in the temperature of the covers and of the roll bodies. For this reason, these are often fitted with cooling facilities. The two effects are the reason why it is not possible to design the rolls in a roll group in such a way that said rolls have precisely equal sag under all operating conditions and for the entire period of use of the rolls, although the above-described inventive production method makes very precise production possible. Two extreme situations may be described for the roll group. On the one hand, the delivered state, with temperatures in the vicinity of ambient temperature and, on the other hand, the respective state in the case of maximum wear of the working layer and maximum operating temperature of the heated chilled cast iron rolls. If, in the delivered state, the rolls were to have identical sag under the influence of gravity, the individual sag values would drift further and further apart with increasing wear and increasing temperature of the heated chilled cast iron rolls. According to the invention, provision is made for this reason to set the sag of rolls having resilient covers to be initially somewhat more severe in the delivered state. For this purpose, the sag values are set by computation in the following ratio to one another:

sag of chilled cast iron roll: sag of polymer roll

In the delivered state, this ratio should be <1, and in the state of the respective maximum wear and operating temperature, it should be >1. By means of fixing the finished diameters of the bores appropriately, it is possible for the extreme ratios to be set preferably in such a way that they have approximately the same absolute deviation from 1. This ensures that the sag values are always substantially equal, even in the case of any combination of rolls within the group.

This can also be achieved by designing the finished diameters of the bores in such a way that the following condition is approximately satisfied:

$$f_{HW1}: f_{PW1} = f_{PW2}: f_{HW2}$$

here:

| | | |
|---|---|---|
| $f_{HW1}$ | = | sag of the chilled cast iron roll (m) |
| $f_{PW1}$ | = | sag of the polymer roll (m) in each case in the new state and at ambient temperature |
| $f_{PW2}$ | = | sag of the polymer roll (m) |
| $f_{HW2}$ | = | sag of the chilled cast iron roll (m) in each case in the state of maximum wear and at maximum operating temperature of the chilled cast iron roll. |

What is claimed is:

1. A group of rolls for processing material webs, the group of rolls including at least two equally flexible rolls comprising:

a reference roll comprising a reference roll body, at least one bolted-on journal, and a central bore; and a second roll comprising a second roll body, at least one bolted-on journal, and a central bore, wherein:

the group of rolls are mounted in rolling-contact bearings in the region of the journals, the reference roll comprises a first cast iron material and the second roll comprises a second cast iron material, each of the reference roll body and the second roll body has a diameter that is greater than 500 millimeters, each of the reference roll and the second roll has a ratio between a web length and a diameter that is greater than seven, the central bore of the reference roll has a diameter such that the wall thickness of the reference roll is between approximately 100 millimeters and 300 millimeters, a first vertical sag $f_{ref}$ is defined as comprising a vertical deflection of an axis of the reference roll under the influence of gravity, wherein the first vertical sag is between 0.1 millimeters and 0.2 millimeters per meter of the web length when the reference roll body is supported in the rolling-contact bearings, a second vertical sag f is defined as comprising a vertical deflection of an axis of the second roll, and the central bore of the second roll has a diameter determined on the basis of a dead weight of the second roll in the region of the web length and a mean modulus of elasticity of the second roll such that the sag f of the second roll is approximately equal to the sag $f_{ref}$ of the reference roll.

2. The group of rolls of claim 1 wherein the first cast iron material comprises one of a chilled cast iron material or a shell chilled cast iron material.

3. The group of rolls of claim 1 wherein the second cast iron material comprises one of a chilled cast iron material, a shell chilled cast iron material, or a cast iron material comprising one or more of a lamellar, vermicular, or spheroidal graphite.

4. The group of rolls of claim 1 wherein the second roll is configured to include a resilient cover.

5. The groups of rolls of claim 4 wherein the resilient cover has a thickness of between 10 mm and 30 mm.

6. The group of rolls of claim 1 wherein the diameter of the central bore of the second roll body is determined by a bore diameter equation defined as:

$$\text{bore diameter} = (D^4 - G \times K_G/(f \times E))^{1/4},$$

with:

G=weight of the roll body (N) in the region of the web length L,

E=modulus of elasticity ($N/m^2$),

D=outer diameter (m) of the roll body, f=intended sag (m), substantially equal to sag $f_{ref}$, and $K_G$=group constant ($m^3$) from the following equation:

$$K_G = (5/(6 \times \pi)) \times L^3 \times (1 + 2.4 \times (LM - L)/L + 2 \times (D_{ref}/L)^2),$$

with:

π=circular constant (3.14159 . . . ),

L=web length of the roll group (m),

LM=bearing-center spacing of the roll group (m), and $D_{ref}$=diameter of the reference roll (m).

7. The group of rolls of claim 1 wherein the second roll body includes at least one peripheral bore through which a liquid or condensable gaseous heat-transfer medium can be passed for heating, cooling or temperature control; and the finished central bore diameter of the second roll body is determined based on the dead weight G of the second roll body and the modulus of elasticity E of the second roll body such that the sag f of the second roll is approximately equal to the sag $f_{ref}$ of the reference roll.

8. The group of rolls of claim 4 wherein the finished diameter of the central bore of the second roll body is determined by a bore diameter equation defined as:

$$\text{bore diameter}=(D^4-Z_P\times D_P^2\times(D_P^2+2\times T_P^2)-G\times K_G/(f\times E))^{1/4},$$

with:

$Z_P$=number of peripheral bores, $D_P$=diameter (m) of the peripheral bores, $T_P$=pitch circle (m) of the peripheral bores, G=weight of the roll body (N) in the region of the web length L, E=modulus of elasticity ($N/m^2$), D=outer diameter (m) of the roll body, f=intended sag (m), substantially equal to sag$f_{ref}$, and $K_G$=group constant ($m^3$) from the following equation:

$$K_G=(5/6\times\pi))\times L^3\times(1+2.4\times(LM-L)/L+2\times(D_{ref}/L)^2),$$

with:

π=circular constant (3.14159 . . . ),

L=web length of the roll group (m),

LM=bearing-center spacing of the roll group (m), and $D_{ref}$=diameter of the reference roll (m).

9. The group of rolls of claim 8 wherein the second roll is configured to include a resilient cover.

10. The groups of rolls of claim 9 wherein the resilient cover has a thickness of between 10 mm and 30 mm.

11. The group of rolls of claim 1 wherein the dead weight G of the second roll body without the bolted-on journal approximately satisfies the following equation in the region of the web length L:

$$G=G_{ref}\times E\times J\times f/(E_{ref}\times J_{ref}\times f_{ref}),$$

with:

$G_{ref}$=weight of the reference roll body (N) without journals in the region of the web length L, $E_{ref}$=modulus of elasticity of the reference roll body ($N/m^3$), $J_{ref}$=moment of inertia of the cross section of the reference roll body ($m^4$), $f_{ref}$=sag of the reference roll (m), E=modulus of elasticity ($N/m^2$), J=moment of inertia of the roll cross section ($m^4$), and f=intended sag (m).

12. The group of rolls of claim 1 wherein the first cast iron material does not comprise chilled-cast iron or shell-chilled cast iron.

13. The group of rolls of claim 1 wherein:

the second roll comprises a polymer roll;

the first sag of the reference roll has a first sag value at a low operating temperature and a second sag value at a high operating temperature;

the second sag of the second roll has a first sag value at the low operating temperature and a second sag value at the high operating temperature; and the bore diameter of the second roll is selected based on a ratio of the first sag value of the reference roll to the first sag value of the polymer roll being approximately equal to a ratio of the second sag value of the polymer roll to the second sag value of the reference roll.

14. The group of rolls of claim 1 wherein the at least one of the reference roll and the second roll includes a displacement body in the central bore such that a heat-transfer medium can flow between the displacement body and the central bore.

15. The group of rolls of claim 1 wherein an outer diameter of the reference roll and an outer diameter of the second roll are essentially equal to one another.

16. The group of rolls of claim 1 wherein the weight of at least one of the reference roll and the second roll is reduced by at least one additional axial bore that is arranged in proximity to a neutral fiber of the roll wall.

17. The group of rolls of claim 16 wherein one or more of the central bore and the at least one additional axial bore are partially or wholly filled with a ballast material.

18. The group of rolls of claim 17 wherein the ballast material comprises a granular material.

19. The group of rolls of claim 17 wherein the ballast material comprises water.

20. A method of producing a group of rolls for processing material webs, the group of rolls including at least two equally flexible rolls, the method comprising:

providing a reference roll comprising a reference roll body, at least one bolted-on journal, and a central bore; and providing a second roll comprising a second roll body, at least one bolted-on journal, and a central bore, wherein:

the group of rolls are mounted in rolling-contact bearings in the region of the journals, the reference roll comprises a first cast iron material and the second roll comprises a second cast iron material, each of the reference roll body and the second roll body has a diameter that is greater than 500 millimeters, each of the reference roll and the second roll has a ratio between a web length and a diameter that is greater than seven, the central bore of the reference roll has a diameter such that the wall thickness of the reference roll is between approximately 100 millimeters and 300 millimeters, a first vertical sag $f_{ref}$ is defined as comprising a vertical deflection of an axis of the reference roll under the influence of gravity, wherein the first vertical sag is between 0.1 millimeters and 0.2 millimeters per meter of the web length when the reference roll body is supported in the rolling-contact bearings, a second vertical sag f is defined as comprising a vertical deflection of an axis of the second roll; and providing the central bore of the second roll with a diameter determined on the basis of the dead weight of the second roll in the region of the web length and the mean modulus of elasticity of the second roll such that the sag f of the second roll is approximately equal to the sag $f_{ref}$ of the reference roll.

21. The method of claim 20 wherein the diameter of the central bore of the second roll body is determined by a bore diameter equation defined as:

$$\text{bore diameter}=(D^4-G\times K_G/(f\times E))^{1/4},$$

with:

G=weight of the roll body (N) in the region of the web length L,

E=modulus of elasticity ($N/m^2$),

D=outer diameter (m) of the roll body, f=intended sag (m), substantially equal to sag $f_{ref}$, and $K_G$=group constant ($m^3$) from the following equation:

$$K_G=(5/(6\times\pi))\times L^3\times(1+2.4\times(LM-L)/L+2\times(D_{ref}/L)^2),$$

with:

π=circular constant (3.14159 . . . ),

L=web length of the roll group (m),

LM=bearing-center spacing of the roll group (m), and $D_{ref}$=diameter of the reference roll (m).

22. The method of claim 21 wherein the second roll has a polymer cover and the diameter of the central bore of the second role is determined on the basis of:

$$D=D_{ref}-2\times(dp-ap),$$

with:

| | | |
|---|---|---|
| $D_{rel}$ | = | a relative diameter (m), |
| dp | = | a thickness of the new polymer cover (m), and |
| ap | = | a maximum possible wear of the polymer cover (m).-- |

23. The method of claim 22 wherein for a second roll body comprising chilled cast iron with spheriodal graphite, the relative diameter comprises an approximately next lower standard diameter of the reference roll in a series of standard diameters of rolls.

24. The method of claim 23 wherein the next lower standard diameter is less by approximately 0.05 meters.

25. The method of claim 22 wherein for a second roll body comprising gray cast iron with lamellar graphite, the relative diameter comprises an approximately next higher standard diameter of the reference roll in a series of standard diameters of rolls.

26. The method of claim 25 wherein the next lower standard diameter is less by approximately 0.05 meters.

27. The method of claim 22 wherein for a second roll body comprising gray cast iron with vermicular graphite, the relative diameter comprises approximately the diameter of the reference roll.

28. The method of claim 22 wherein for a second roll body comprising any material, the relative diameter corresponds to the following equation:

$$D=(16\times G\times K_G/(15\times E\times f_{ref}))^{1/4},$$

with:

| | | |
|---|---|---|
| G | = | a weight (N) of the roll body in the region of the web length L, |
| E | = | a modulus of elasticity of the roll body ($N/m^2$), |
| $f_{ref}$ | = | a sag (m) of the reference roll, and |
| $K_G$ | = | a group constant ($m^3$) from the following equation: |
| $K_G$ | = | $(5/(6\times\pi))\times L^3\times(1+2.4\times(LM-L)/L+2\times(D_{ref}/L)^2)$ |
| with: | | |
| π | = | the circular constant (3.14159 . . . ), |
| L | = | a web length of the roll group (m), |
| LM | = | a bearing-center spacing of the roll group (m), and |
| $D_{ref}$ | = | a diameter of the reference roll (m).-- |

29. The method of claim 20 further comprising determining a maximum permissible diameter of the central bore of the second roll, wherein determining the diameter comprises using the maximum ovalization of the roll body in the determination.

30. The method of claim 20 further comprising setting an equality of a bending of rolls made of chilled cast iron or shell-chilled cast iron, wherein a resulting moment of inertia of a roll cross-section is varied by reducing the outer diameter of the roll within plus or minus one percent.

31. The method of claim 20 wherein the equality of the bending of the rolls in the roll group is determined by:

establishing an actual mean modulus of elasticity of the roll bodies during the production of the roll bodies by measuring the bending of one or more of the dead weight of the roll bodies, the bending which results from the application of at least one external force to the roll bodies, and the measurement of the eigenfrequency;

defining the finished outer diameter of the roll body; and producing the roll body with the finished outer diameter within a production tolerance of approximately plus or minus one percent, whereby a finished inner diameter of the bore of the roll body is defined and produced based on one or more respective local moduli of elasticity.

32. The method of claim 20 further comprising:

determining a sag during operation;

determining an amount of a heat-transfer medium to introduce into one or more peripheral bores and/or the central bore; and operating the group of rolls while introducing the heat-transfer medium in the determined amount.

33. The method of claim 20 further comprising partially or completely filling the rolls with a ballast material.

34. The method of claim 33 further comprising varying the amount of ballast material in the rolls during an operation of the rolls.

35. The method of claim 20 further comprising determining dimensions of the rolls such that the rolls are not operated at a speed close to a semicritical rotational speed.

* * * * *

UNITED STATES PATENT AND TRADEMARK OFFICE

CERTIFICATE OF CORRECTION

PATENT NO. : 6,588,332 B1
DATED : July 8, 2003
INVENTOR(S) : Jurgen Kruger et al.

It is certified that error appears in the above-identified patent and that said Letters Patent is hereby corrected as shown below:

Column 13,
Line 1, change “of claim 4” to -- of claim 7 --.

Signed and Sealed this

Eleventh Day of November, 2003

JAMES E. ROGAN
*Director of the United States Patent and Trademark Office*